US010436521B2

(12) United States Patent
Cho et al.

(10) Patent No.: US 10,436,521 B2
(45) Date of Patent: Oct. 8, 2019

(54) DUAL-MODE THERMAL MANAGEMENT LOOP

(71) Applicant: HAMILTON SUNDSTRAND CORPORATION, Charlotte, NC (US)

(72) Inventors: Wei-Lin Cho, Unionville, CT (US); Gary A. Adamson, North Granby, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 23 days.

(21) Appl. No.: 15/429,754

(22) Filed: Feb. 10, 2017

(65) Prior Publication Data

US 2018/0231327 A1 Aug. 16, 2018

(51) Int. Cl.

| | |
|---|---|
| ***F28D 15/06*** | (2006.01) |
| ***F28D 15/02*** | (2006.01) |
| ***F28D 15/04*** | (2006.01) |
| ***F28F 27/02*** | (2006.01) |

(52) U.S. Cl.

CPC ..... *F28D 15/06* (2013.01); *F28D 15/025* (2013.01); *F28D 15/0258* (2013.01); *F28D 15/0266* (2013.01); *F28D 15/04* (2013.01); *F28D 15/043* (2013.01); *F28F 27/02* (2013.01)

(58) Field of Classification Search

CPC ..... F28D 15/06; F28D 15/043; F28D 15/025; F28D 15/0266; F28D 15/04

USPC ..... 165/274, 104.26, 104.33

See application file for complete search history.

(56) References Cited

U.S. PATENT DOCUMENTS

| | | | | |
|---|---|---|---|---|
| 4,470,759 | A | 9/1984 | Kosson | |
| 4,750,543 | A | 6/1988 | Edelstein | |
| 4,903,761 | A * | 2/1990 | Cima | F28D 15/043 122/366 |
| 5,103,897 | A * | 4/1992 | Cullimore | F28D 15/043 165/104.26 |
| 6,533,029 | B1 | 3/2003 | Phillips | |

(Continued)

FOREIGN PATENT DOCUMENTS

EP 2985556 2/2016

OTHER PUBLICATIONS

European Patent Office, European Search Report dated Jun. 27, 2018 in Application No. 18154168.1.

US 8,381,805, 2/2013, Alliant Techsystems Inc. (withdrawn)

*Primary Examiner* — Joel M Attey

(74) *Attorney, Agent, or Firm* — Snell & Wilmer L.L.P.

(57) ABSTRACT

A system may include a pump, an evaporator, a condenser, an accumulator, a pump bypass line, a first valve, and a second valve. The system may operate in a powered-pump mode, in which the pump drives fluid circulation, the first valve prevents fluid circulation through the pump bypass line, the pump pumps liquid from the accumulator to the evaporator, gas exiting the evaporator flows to the condenser, liquid exiting the evaporator flows through the second valve to the accumulator, and liquid exiting the condenser flows to the accumulator. The system may operate in a passive-capillary mode, in which capillary pressure in the evaporator drives fluid circulation, the first valve prevents fluid circulation through the pump, liquid flows from the accumulator, through the pump bypass line, and to the evaporator, gas exiting the evaporator flows to the condenser, the second valve is closed, and liquid exiting the condenser flows the accumulator.

8 Claims, 6 Drawing Sheets

(56) References Cited

U.S. PATENT DOCUMENTS

| | | | | |
|---|---|---|---|---|
| 6,615,912 | B2 | 9/2003 | Garner | |
| 6,626,231 | B2 | 9/2003 | Cluzet et al. | |
| 6,840,304 | B1 | 1/2005 | Kobayashi et al. | |
| 6,948,556 | B1 * | 9/2005 | Anderson | F28D 15/0266 165/104.26 |
| 7,334,630 | B2 | 2/2008 | Goodson | |
| 7,661,464 | B2 | 2/2010 | Khrustalev et al. | |
| 7,770,630 | B2 | 8/2010 | Chesser et al. | |
| 8,567,486 | B1 | 10/2013 | Wolf, Sr. | |
| 8,596,341 | B2 | 12/2013 | Tegrotenhuis et al. | |
| 8,696,794 | B2 | 4/2014 | Paragano et al. | |
| 8,752,616 | B2 | 6/2014 | Kroliczek et al. | |
| 9,046,288 | B2 | 6/2015 | Cho | |
| 9,146,059 | B2 | 9/2015 | Hoang | |
| 9,273,887 | B2 | 3/2016 | Kroliczek et al. | |
| 2009/0229283 | A1 | 9/2009 | Marsala | |
| 2012/0017625 | A1 * | 1/2012 | Kroliczek | F25B 23/006 62/335 |
| 2014/0246095 | A1 | 9/2014 | Ellis | |
| 2015/0114607 | A1 | 4/2015 | Moscatelli | |
| 2015/0338171 | A1 | 11/2015 | Torres Sep Iveda et al. | |
| 2016/0047605 | A1 | 2/2016 | Mishkinis et al. | |
| 2016/0366789 | A1 | 12/2016 | Chainer et al. | |

* cited by examiner

DUAL-MODE THERMAL MANAGEMENT LOOP

FIELD

The present disclosure relates to heat exchangers and, more specifically, to two-phase heat exchangers.

BACKGROUND

Heat exchangers are used in a variety of applications. Single phase liquid heat exchangers, for example, are often used to cool and/or heat components of a system. In such heat exchangers, a liquid is pumped across a component and sensible heat is transferred between the liquid and the component and thus the liquid changes temperature. These heat exchangers rely on the sensible heat capacity of the liquid to transfer heat. However, these single phase heat exchangers often require large volumes of liquid, which can increase the overall operating costs of a heat exchanger system.

SUMMARY

In various embodiments, the present disclosure provides a dual-mode thermal management loop system that is configured to operate in either a powered-pump mode or a passive-capillary mode. The dual-mode thermal management loop system includes a pump, an evaporator in fluid receiving communication with the pump, a condenser in fluid receiving communication with the evaporator, an accumulator in fluid receiving communication with the evaporator and the condenser, a pump bypass line in fluid communication with the accumulator, a first valve in fluid communication with the evaporator, and a second valve in fluid communication with the evaporator, according to various embodiments. In the powered-pump mode, the pump drives fluid circulation, the first valve prevents fluid circulation through the pump bypass line, the pump pumps liquid from the accumulator to the evaporator, gas exiting the evaporator flows to the condenser, liquid exiting the evaporator flows through the second valve to the accumulator, and liquid exiting the condenser flows to the accumulator, according to various embodiments. In the passive-capillary mode, capillary pressure in the evaporator drives fluid circulation, the first valve prevents fluid circulation through the pump, liquid flows from the accumulator, through the pump bypass line, and to the evaporator, gas exiting the evaporator flows to the condenser, the second valve is closed, and liquid exiting the condenser flows the accumulator.

In various embodiments, the evaporator is a porous media evaporator. In various embodiments, in the passive-capillary mode all the liquid entering the evaporator evaporates to gas. In the powered-pump mode, the second valve may include a back pressure valve that controls back pressure in the evaporator. The second valve may also control flow of gas from the evaporator. In various embodiments, the porous media evaporator is a first porous media evaporator and the dual-mode thermal management loop system further includes a second porous media evaporator. In various embodiments, the first porous media evaporator and the second porous media evaporator are arranged in parallel. The first porous media evaporator may include two porous tubes arranged in parallel. In various embodiments, the porous media evaporator includes an average pore size diameter of between about 1.0 micrometer and about 5.0 micrometers.

Also disclosed herein, according to various embodiments, is a dual-mode thermal management loop system configured to operate in either a powered-pump mode or a passive-capillary mode. The dual-mode thermal management system may include a controller having a processor and a tangible, non-transitory memory configured to communicate with the processor. The tangible, non-transitory memory may have instructions stored thereon that, in response to execution by the processor, cause the dual-mode thermal management loop system to perform various operations. Such various operations performed by the dual-mode thermal management loop system may include identifying, by the processor, a heat transfer load on the dual-mode thermal management loop system. The various operations may further include determining, by the processor, whether the heat transfer load exceeds a predetermined threshold and, in response to determining that the heat transfer load does not exceed the predetermined threshold, operating, by the processor, the dual-mode thermal management loop system in the passive-capillary mode. The various operations may further include, in response to determining that the heat transfer load exceeds the predetermined threshold, operating, by the processor, the dual-mode thermal management loop system in the powered-pump mode.

In various embodiments, identifying the heat transfer load includes detecting a temperature of a heat source that is in heat receiving communication with an evaporator. Identifying the heat transfer load may include detecting a location of a liquid-vapor interface of an evaporator. The evaporator may be a porous media evaporator. In various embodiments, operating the dual-mode thermal management loop system in the passive-capillary mode includes transmitting a first valve command to a first valve to prevent fluid circulation through a pump. According to various embodiments, operating the dual-mode thermal management loop system in the passive-capillary mode includes transmitting a second valve command to a second valve fluidly connected in a liquid surplus line downstream of an evaporator to close.

In various embodiments, operating the dual-mode thermal management loop system in the powered-pump mode includes transmitting a pump command to a pump. Operating the dual-mode thermal management loop system in the powered-pump mode may include transmitting a first valve command to a first valve to prevent fluid circulation through a pump bypass line. In such embodiments, operating the dual-mode thermal management loop system in the powered-pump mode includes transmitting a second valve command to a second valve fluidly connected downstream of a liquid outlet to control back pressure in an evaporator.

Also disclosed herein, according to various embodiments, is a method of controlling a dual-mode thermal management loop system. The method may include identifying, by a controller, a heat transfer load on the dual-mode thermal management loop system. The method may further include determining, by the controller, whether the heat transfer load exceeds a predetermined threshold. Still further, the method may include, in response to determining that the heat transfer load does not exceed the predetermined threshold, operating, by the controller, the dual-mode thermal management loop system in a passive-capillary mode and, in response to determining that the heat transfer load exceeds the predetermined threshold, operating, by the controller, the dual-mode thermal management loop system in a powered-pump mode. In various embodiments, identifying the heat transfer load includes detecting a location of a liquid-vapor interface of an evaporator.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
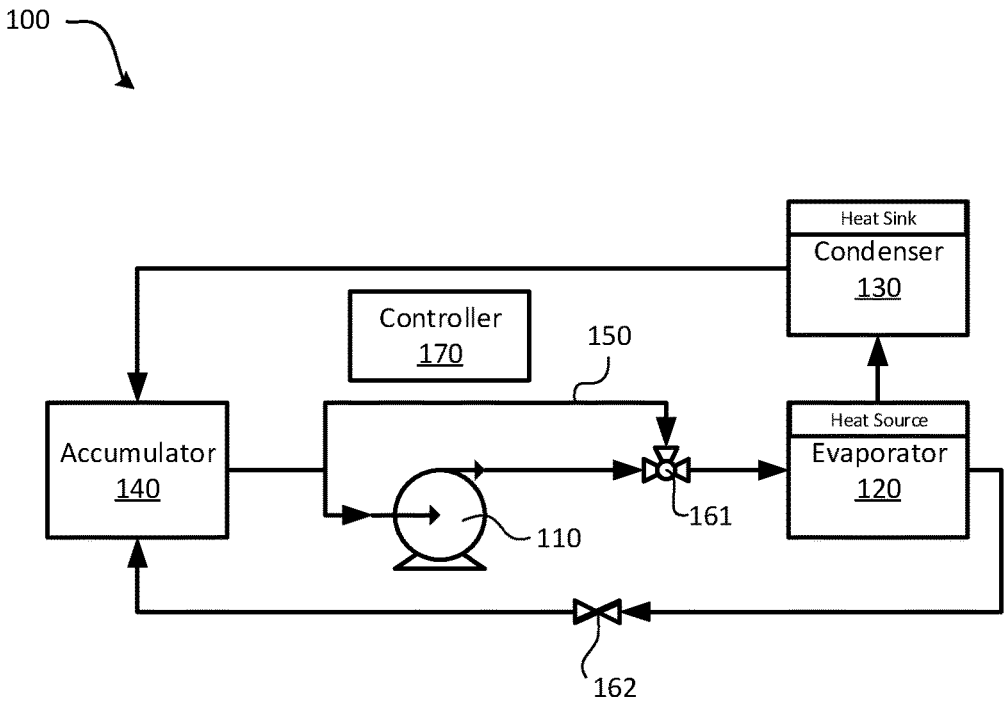
FIG. 1 illustrates a schematic block diagram of a dual-mode thermal management loop system, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation. Throughout the present disclosure, like reference numbers denote like elements.

Disclosed herein, according to various embodiments, is a dual-mode thermal management loop system. As mentioned above, conventional heat exchanger systems have various deficiencies relating to complexity, operating costs, component failure, control, etc. For example, heat exchanger systems that utilize a pump to drive fluid circulation can be difficult to control in low heat load situations while heat exchanger systems that utilize a passive driving force, such as capillary pressure (as described in greater detail below), may not have sufficient capacity to manage high heat load situations. Additionally, heat exchangers that rely solely on a pump to drive fluid circulation may be susceptible to periods of non-use in the event of pump failure. The dual-mode thermal management loop system of the present disclosure, however, provides a system architecture that can toggle between operating modes in order to improve operating efficiency, account for pump failure, and manage varying (or variable) heat loads.

In various embodiments, and with reference to FIG. 1, the dual-mode thermal management loop system 100 is provided. The dual-mode thermal management loop system 100 includes a pump 110, an evaporator 120, a condenser 130, an accumulator 140, a pump bypass line 150, a first valve 161, and a second valve 162, according to various embodiments. The evaporator 120 may be in selective fluid receiving communication with the pump 110. The condenser 120 may be in fluid receiving communication with the evaporator 120. The accumulator 140 may be in fluid receiving communication with the evaporator 120 and the condenser 130. The pump bypass line 150 may be in fluid communication with the accumulator 140. The first valve 161 may be in fluid communication with the evaporator 120. The second valve 162 may be in fluid communication with the evaporator 120.

The evaporator 120 is downstream of the pump 110 and the pump bypass line 150, according to various embodiments. An outlet of the pump 110 and the pump bypass line 150 may be coupled to the first valve 161. The first valve 161 generally controls whether the evaporator 120 is supplied with liquid from the pump 110 or liquid from the pump bypass line 150, as described in greater detail below. In various embodiments, the evaporator 120 is in heat receiving communication with a heat source. Heat from the heat source is transferred to the liquid flowing through the evaporator 120. Both latent heat transfer and sensible heat transfer may occur in the evaporator 120, with evaporated gas flowing out of the evaporator 120 via a gas outlet towards the condenser 130 and any non-evaporated, surplus liquid flowing to the accumulator 140. The condenser 130 may be in heat rejecting thermal communication with a heat sink and may be configured to condense the gas into a liquid before the condensate is directed to the accumulator 140 as well.

The dual-mode thermal management loop system 100 may further include a controller 170, as described in greater detail below, that is configured to control the various components of the system 100. Generally, the dual-mode thermal management loop system 100 is configured to operate in either a powered-pump mode (see below with reference to FIG. 2A) or in a passive-capillary mode (see below with reference to FIG. 2B).

Figure 2A:
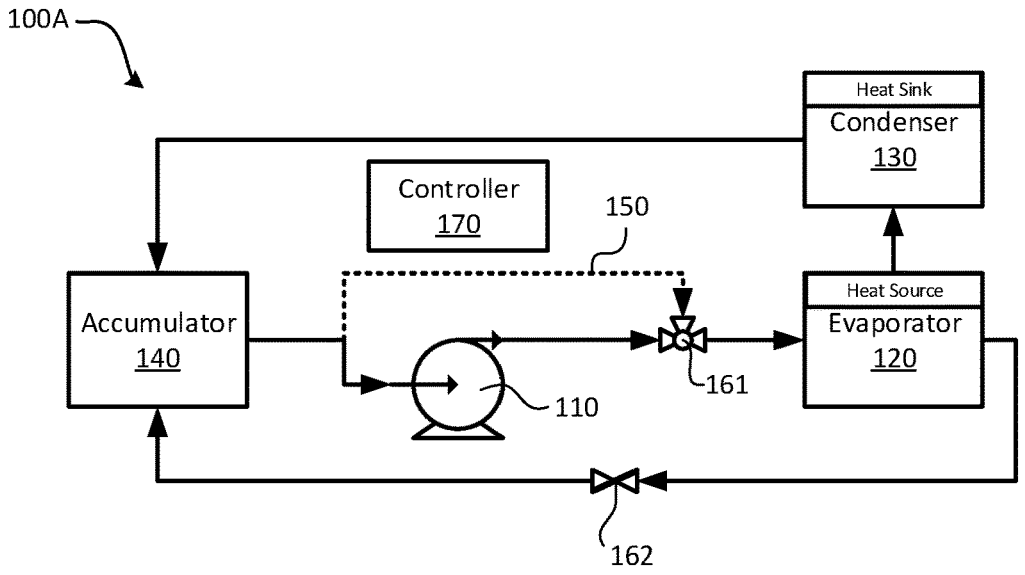
FIG. 2A illustrates a schematic block diagram of the dual-mode thermal management loop system of FIG. 1 operating in a powered-pump mode, in accordance with various embodiments.

In various embodiments, and with reference to FIG. 2A, the dual-mode thermal management loop system 100 is shown in the powered-pump mode 100A. In the powered-pump mode 100A, according to various embodiments, the pump 110 drives fluid circulation and the first valve 161 is arranged to prevent fluid circulation through the bump bypass line 150 (dashed lines throughout the figures refer to the portions—e.g., tubes, pipes, channels, lines, etc.—of the system 100 that do not have fluid circulating therethrough). In the powered-pump mode 100A, the pump 110 is configured to pump liquid from the accumulator 140 to the evaporator 120. Gas exiting the evaporator 120 (i.e., gas generated via evaporation) flows to the condenser 130 while surplus liquid exiting the evaporator 120 flows through the second valve 162, which remains at least partially open, to the accumulator 140 for recirculation.

Figure 2B:
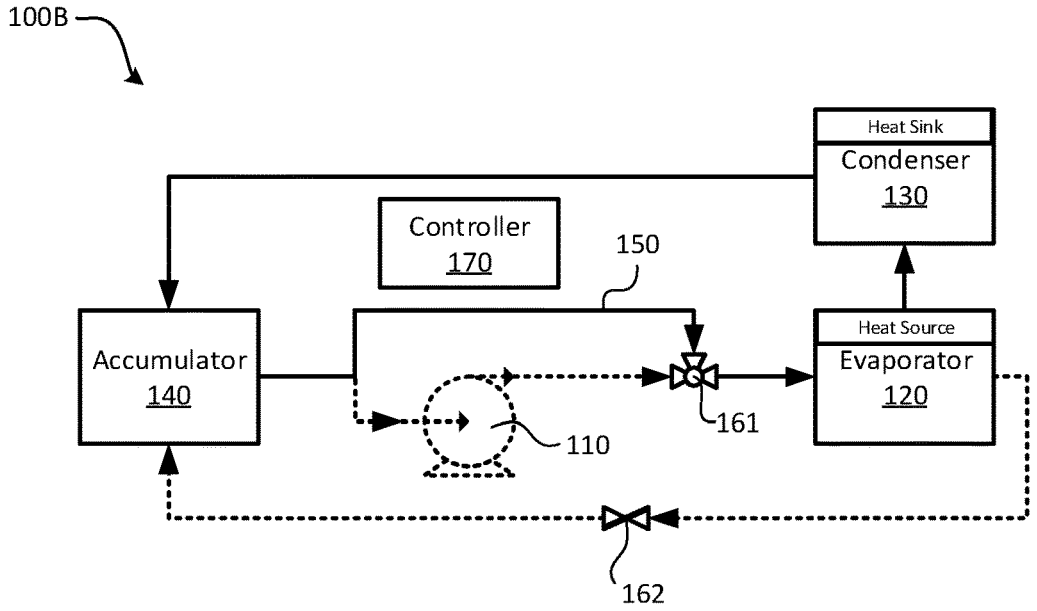
FIG. 2B illustrates a schematic block diagram of the dual-mode thermal management loop system of FIG. 1 operating in a passive-capillary mode, in accordance with various embodiments.

In various embodiments, and with reference to FIG. 2B, the dual-mode thermal management loop system 100 is shown in the passive-capillary mode 100B. In the passive-capillary mode 100B, according to various embodiments, capillary pressure (described in greater detail below) in the evaporator 120 drives fluid circulation and the first valve 161 prevents fluid circulation through the pump 110. Additionally, the second valve 162 is closed, according to various embodiments, and thus no surplus liquid flows out the evaporator 120. In the passive-capillary mode 100B, liquid flows from the accumulator 140 to the evaporator 120 via the pump bypass line 150. Gas exiting the evaporator 120 flows to the condenser 130 and the resulting condensate flows to the accumulator 140. As mentioned above, the evaporator 120 does not have surplus liquid exiting and thus the exclusive outlet of the evaporator 120 in the passive-capillary mode 100B is a gas outlet that flows into the condenser 130. Said differently, in the passive-capillary mode 100B, according to various embodiments, all the liquid entering the evaporator evaporates to gas.

The capillary pressure, according to various embodiments, is based on the surface tension of the liquid and the pore size of the features in the evaporator 120. In various embodiments, the evaporator 120 is a porous media evaporator that utilizes a porous media to separate the liquid from the gas during evaporation. The porous media of the evaporator 120 may be positioned within a housing and the porous media may form a conduit. In various embodiments, fluidic communication between the conduit formed by the porous media and a gas outlet is through a porous wall of the porous media. In other words, and according to various embodiments, fluid communication between the conduit and the gas outlet is limited/restricted to the pores of the porous wall that form the conduit of the porous media. In various embodiments, the average pore size (e.g., diameter) of the porous media is between about 0.1 micrometers and about 20 micrometers. In various embodiments, the average pore size of the porous media is between about 0.5 micrometers and about 10 micrometers. In various embodiments, the average pore size of the porous media is between about 1 micrometer and about 5 micrometers. As used in this context, the term about means plus or minus 0.1 micrometer. The size of the pores may be specifically configured for a specific application. For example, the size of the pores, together with the surface tension properties of the liquid, affect the capillary action of the pores and thus affect the overall fluid circulation rate and the heat transfer capacity of the system.

In operation, liquid enters the porous media conduit (whether by being pumped in or whether by being drawn in via capillary pressure) via a liquid inlet of the evaporator. As mentioned above, the evaporator may be in heat receiving communication with a heat source. In response to the heat transferring into the evaporator from the heat source, the liquid flowing through the porous media conduit may receive latent heat and at least a portion of the liquid undergoes a phase change (e.g., evaporates).

The porous media may be made from various materials, such as ceramic materials, metallic materials, composite materials, etc. For example, the porous media may be constructed from a monolithic ceramic material and/or from a metallic screen mesh or a metallic felt-like material. The porous media may include multiple layers. In various embodiments, the porous media is disposed in direct physical contact with the housing of the evaporator 120 in order to promote efficient heat transfer between the housing and the porous media.

Figure 3:
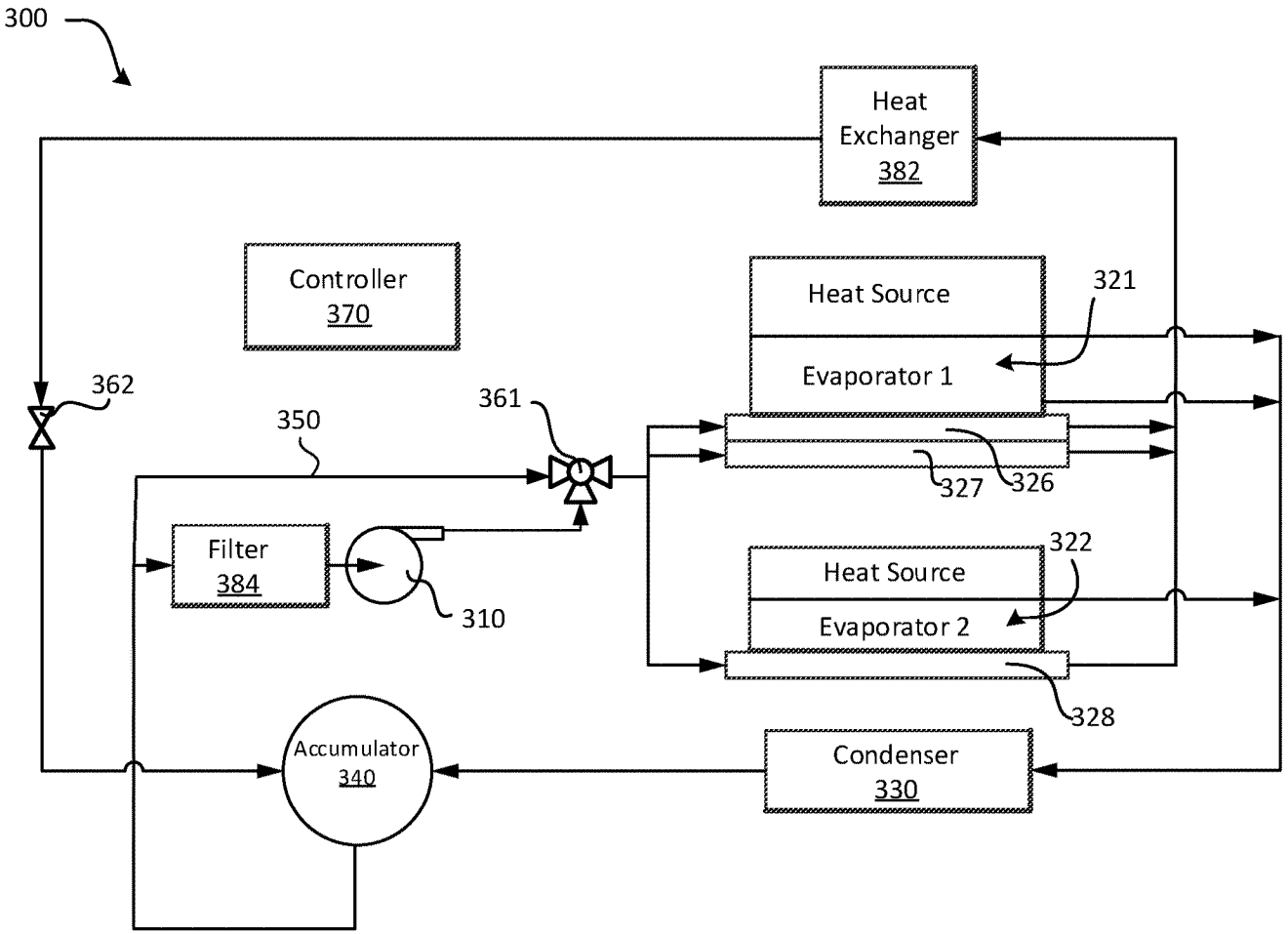
FIG. 3 illustrates a schematic block diagram of a dual-mode thermal management loop system, in accordance with various embodiments.
Figure 4A:
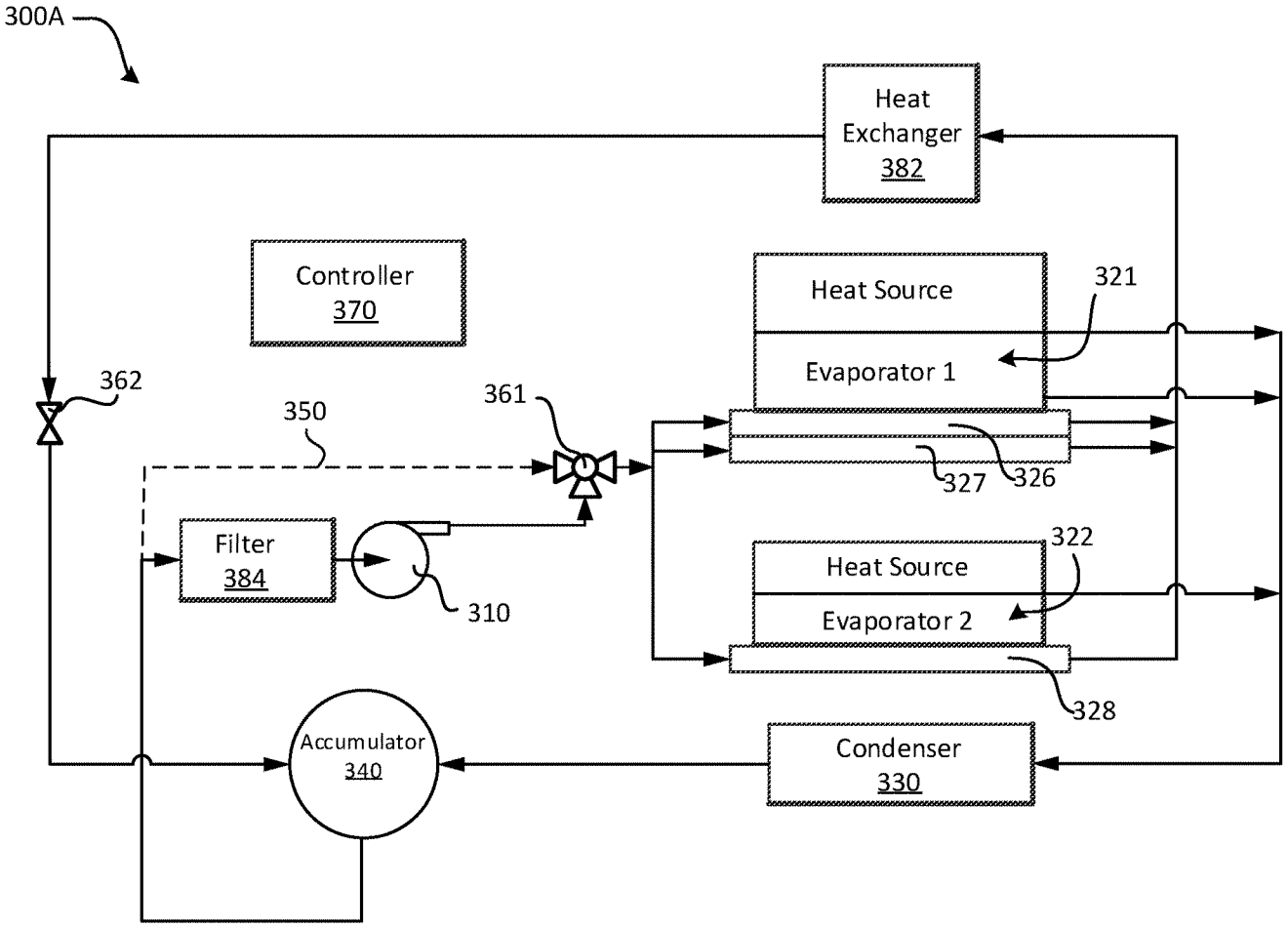
FIG. 4A illustrates a schematic block diagram of the dual-mode thermal management loop system of FIG. 3 operating in a powered-pump mode, in accordance with various embodiments.
Figure 4B:
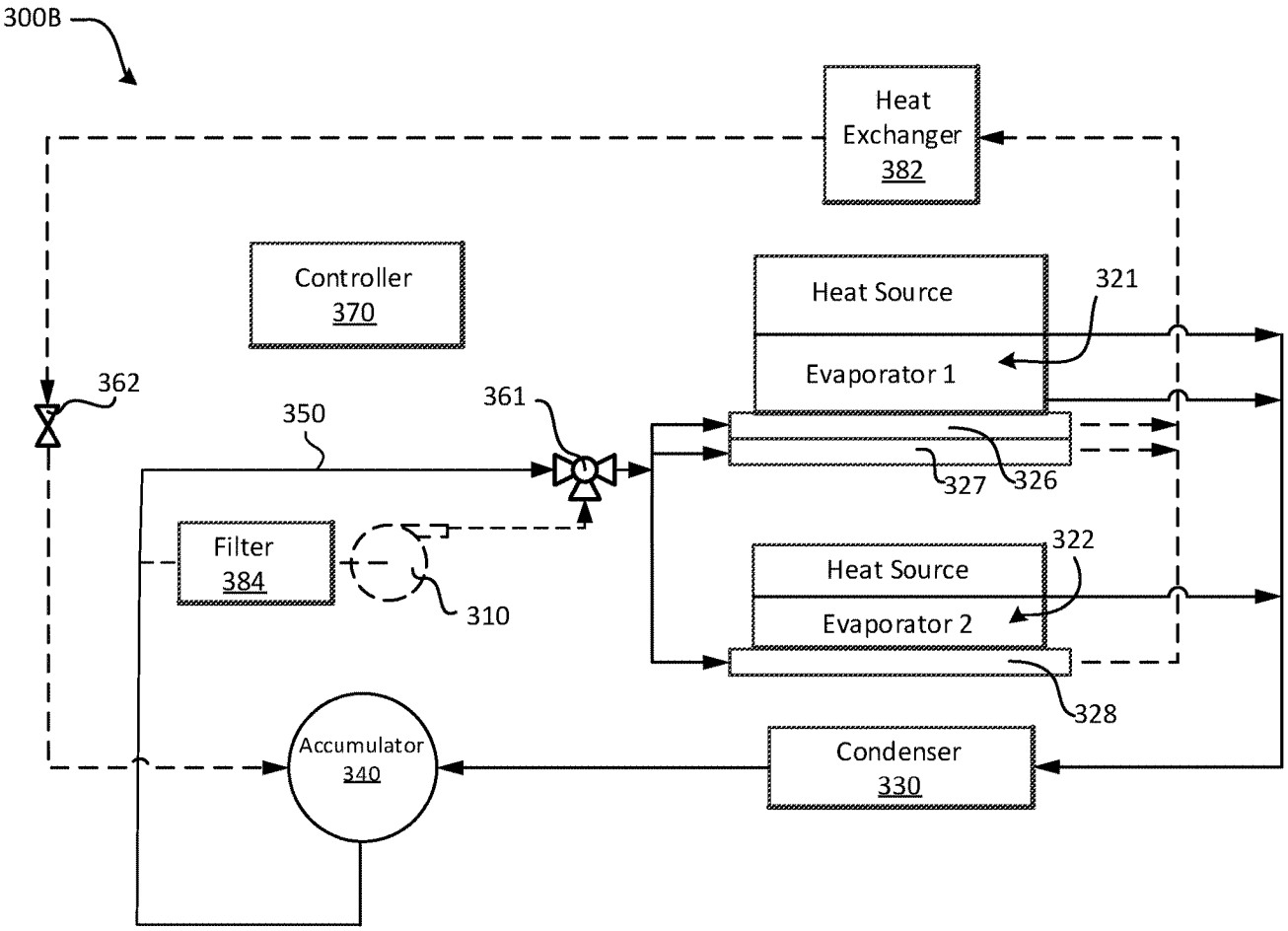
FIG. 4B illustrates a schematic block diagram of the dual-mode thermal management loop system of FIG. 3 operating in a passive-capillary mode, in accordance with various embodiments.

In various embodiments, and with reference to FIGS. 3, 4A, and 4B, the dual-mode thermal management loop system 300 is provided. As mentioned previously, like reference numerals refer to like elements. Accordingly, pump 310 shown in FIGS. 3, 4A, and 4B is similar to pump 110 of FIGS. 1, 2A, and 2B and thus a description of the pump 310, and other elements with reference numbers that are similar to the reference numbers of elements described above, will not necessarily be repeated below.

The dual-mode thermal management loop system 300 may include, with reference to FIG. 3, multiple evaporators 321, 322. The evaporators 321, 322 may be arranged in parallel. In various embodiments, the evaporators 321, 322 may include a porous media conduit 326, 327, 328. In various embodiments, one of the evaporators 321 may include multiple porous media conduits 326, 327 while another of the evaporators 322 may have a single porous media conduit 328. The dual-mode thermal management loop system 300 includes, according to various embodiments, a filter 384 disposed upstream of the pump 310 and a heat rejecting heat exchanger fluidly connected downstream of the surplus liquid exiting the evaporators 321, 322.

In various embodiments, and with reference to FIG. 4A, the dual-mode thermal management loop system 300 is shown in the powered-pump mode 300A. In the powered-pump mode 300A, according to various embodiments, the pump 310 drives fluid circulation and the first valve 361 is arranged to prevent fluid circulation through the bump bypass line 350 (dashed lines throughout the figures refer to the portions—e.g., tubes, pipes, channels, lines, etc.—of the system 300 that do not have fluid circulating therethrough). In the powered-pump mode 300A, the pump 310 is configured to pump liquid from the accumulator 340 to the evaporators 321, 322. Gas exiting the evaporators 321, 322 (i.e., gas generated via evaporation) flows to the condenser 330 while surplus liquid exiting the evaporators 321, 322 flows through the second valve 362, which remains at least partially open, to the accumulator 340 for recirculation.

In various embodiments, the second valve 362, when the system 300 is in the powered-pump mode 300A, is a back pressure valve that controls back pressure in the evaporators 321, 322. The second valve 362 may further be configured to control the flow of gas from the evaporator, due to the back pressure effect of the second valve 362 on the evaporators 321, 322.

In various embodiments, and with reference to FIG. 4B, the dual-mode thermal management loop system 300 is shown in the passive-capillary mode 300B. In the passive-capillary mode 300B, according to various embodiments, capillary pressure (described in greater detail below) in the evaporators 321, 322 drives fluid circulation and the first valve 361 prevents fluid circulation through the pump 310. Additionally, the second valve 362 is closed, according to various embodiments, and thus no surplus liquid flows out of the evaporators 321, 322. In the passive-capillary mode 300B, liquid flows from the accumulator 340 to the evaporators 321, 322 via the pump bypass line 350. Gas exiting the evaporators 321, 322 flows to the condenser 330 and the resulting condensate flows to the accumulator 340. As mentioned above, the evaporators 321, 322 do not have any surplus liquid exiting and thus the exclusive outlet of the evaporators 321, 322 in the passive-capillary mode 300B is a gas outlet that flows into the condenser 330. Said differently, in the passive-capillary mode 300B, according to various embodiments, all of the liquid entering the evaporator evaporates to gas.

As mentioned above, the dual-mode thermal management loop system 300 may include a controller 370 for controlling the various components, elements, and valves of the system 300. The dual-mode thermal management loop system 300 may include additional components, such as pressure and temperature sensors. Such sensors may be positioned at various locations throughout the system and may be in electronic communication with the controller 370. Additionally, the valves 361, 362 of the system 300 may be in electronic communication with the controller 370 and the controller 370 may be able to transmit commands to the valves 361, 362 and other components to actuate and control the dual-mode thermal management loop system 300.

The controller 370, according to various embodiments, includes a processor. The processor(s) can be a general purpose processor, a digital signal processor (DSP), an application specific integrated circuit (ASIC), a field programmable gate array (FPGA) or other programmable logic device, discrete gate or transistor logic, discrete hardware components, or any combination thereof. In various embodiments, the processor can be configured to implement various logical operations in response to execution of instructions, for example, instructions stored on a non-transitory, tangible, computer-readable medium. As used herein, the term "non-transitory" is to be understood to remove only propagating transitory signals per se from the claim scope and does not relinquish rights to all standard computer-readable media that are not only propagating transitory signals per se. Stated another way, the meaning of the term "non-transitory computer-readable medium" and "non-transitory computer-readable storage medium" should be construed to exclude only those types of transitory computer-readable media which were found in In Re Nuijten to fall outside the scope of patentable subject matter under 35 U.S.C. § 101.

The processor of the controller 370 may execute various instructions stored on the tangible, non-transitory memory to cause the dual-mode thermal management loop system 300 to perform various operations. These operations include, according to various embodiments, identifying a heat transfer load on the dual-mode thermal management loop system 300. The operations may further include determining whether the identified heat transfer load exceeds a predetermined threshold. If it is determined that the heat transfer load does not exceed the predetermined threshold, the processor may operate the dual-mode thermal management loop system 300 in the passive-capillary mode 300B. If it is determined that the heat transfer load exceeds the predetermined threshold, the processor may operate dual-mode thermal management loop system 300 in the powered-pump mode 300A.

In various embodiments, the controller 370 may continue to monitor the heat transfer load so that the controller 370 can swap operation of the system 300 between the two modes 300A, 300B as necessary. In various embodiments, the controller 370 may be configured to operate the system 300 in the passive-capillary mode 300B if the pump 310 fails. Additionally, according to various embodiments, the controller 370 can have control over the heat sources themselves, thereby allowing the controller 370 to select the heat transfer load. In such embodiments, the controller 370 may be configured to directly change the operating mode of the system 300 based on the selected heat transfer load.

In various embodiments, identifying the heat transfer load includes detecting a temperature of a heat source that is in heat receiving communication with the evaporator(s) 321, 322. In various embodiments, identifying the heat transfer load includes detecting a location of a liquid-vapor interface of the evaporator(s) 321, 322. Said differently, the controller 370 may be configured to monitor the porous media 326, 327, 328 of the evaporators 321, 322 (through various pressure sensors/transducers) to determine if the amount of liquid in the porous media is reduced (i.e, "drying out") due to insufficient liquid flow. For example, the liquid-vapor interface may be pushed from a vapor side of the evaporator 321, 322 to a liquid side of the evaporator 321, 322, which may damage the porous media. In such embodiments, the controller 370 may adjust the pump power and/or increase the liquid surplus back pressure via the second valve 362.

In various embodiments, operating the dual-mode thermal management loop system 300 in the passive-capillary mode 300B includes transmitting a first valve command to the first valve 361 to prevent fluid circulation through the pump 310. In various embodiments, operating the dual-mode thermal management loop system 300 in the passive-capillary mode 300B includes transmitting a second valve command to the second valve 362 to close. In various embodiments, operating the dual-mode thermal management loop system 300 in the powered-pump mode 300A includes transmitting a pump command to the pump 310 and/or transmitting a first valve command to the first valve 361 to prevent fluid circulation through the pump bypass line 350. Operating in the powered-pump mode 300A may further include transmitting a second valve command to the second valve 362 to control back pressure in the evaporator(s) 321, 322.

Figure 5:
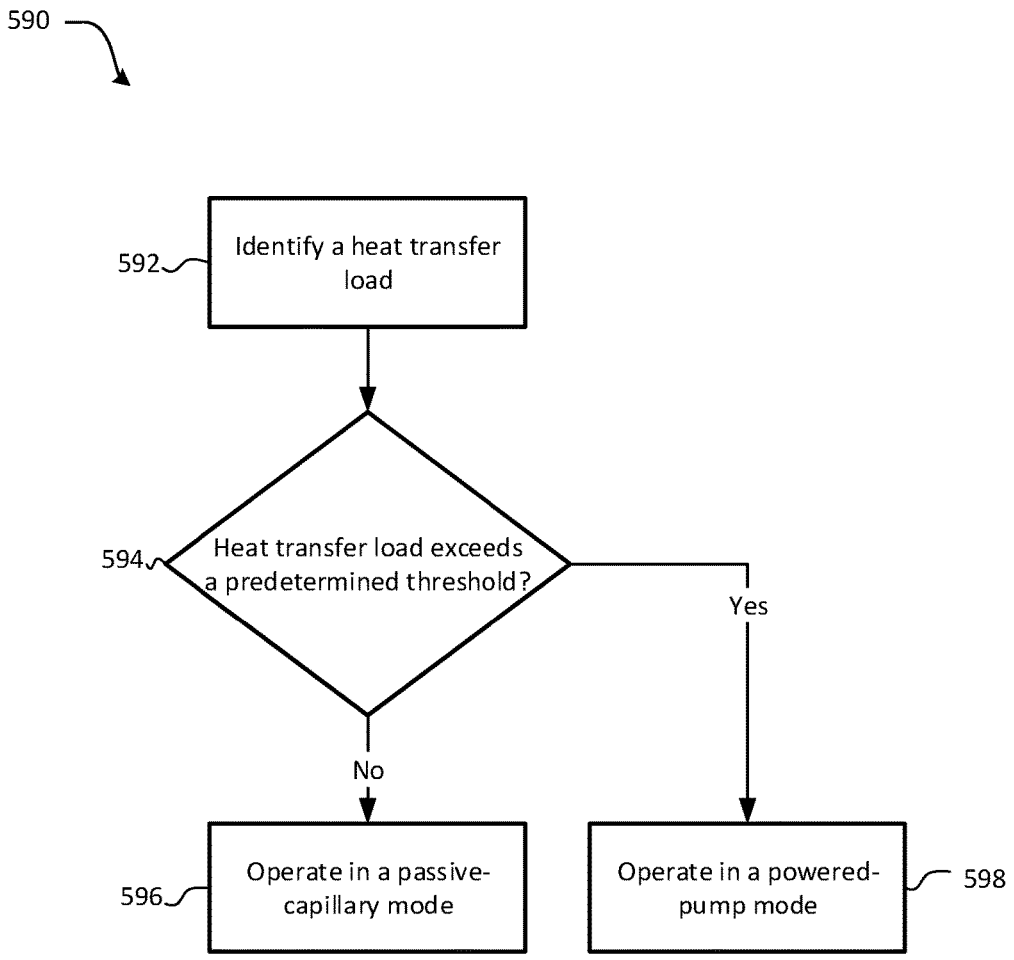
FIG. 5 illustrates a schematic flow chart diagram of a method of controlling a dual-mode thermal management loop system, in accordance with various embodiments.

In various embodiments, and with reference to FIG. 5, a method 590 of controlling a dual-mode thermal management loop system is provided. The method 590, according to various embodiments, includes identifying, by a controller, a heat transfer load at step 592 and determining, by a controller, whether the heat transfer load exceeds a predetermined threshold at step 594. In response to determining that the heat transfer load does not exceed the predetermined threshold, the method 590 may include operating, by the controller, the dual-mode thermal management loop system in a passive-capillary mode at step 596. In response to determining that the heat transfer load exceeds the predetermined threshold, the method 590 may include operating, by the controller, the dual-mode thermal management loop system in a powered-pump mode at step 598. In various embodiments, step 592 includes detecting a location of a liquid-vapor interface of an evaporator.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A dual-mode thermal management loop system configured to operate in either a powered-pump mode or a passive-capillary mode, wherein the dual-mode thermal management loop system comprises:

a pump; an evaporator in fluid receiving communication with the pump; a condenser in fluid receiving communication with the evaporator; an accumulator in fluid receiving communication with the evaporator and the condenser; a pump bypass line in fluid communication with the accumulator; a first valve in fluid communication with the evaporator; and a second valve fluidly connected in a liquid surplus line in fluid communication with the evaporator; wherein the liquid surplus line bypasses the condenser;

wherein in the powered-pump mode:

the pump drives fluid circulation;

the first valve prevents fluid circulation through the pump bypass line;

the pump pumps liquid from the accumulator to the evaporator;

gas exiting the evaporator flows to the condenser;

liquid exiting the evaporator flows through the liquid surplus line through the second valve to the accumulator;

the second valve comprises a back pressure valve that controls liquid back pressure in the evaporator; and liquid exiting the condenser flows to the accumulator;

wherein in the passive-capillary mode:

capillary pressure in the evaporator drives fluid circulation;

the first valve prevents fluid circulation through the pump;

liquid flows from the accumulator, through the pump bypass line, and to the evaporator;

gas exiting the evaporator flows to the condenser;

the second valve is closed; and liquid exiting the condenser flows the accumulator.

2. The dual-mode thermal management loop system of claim 1, wherein the evaporator is a porous media evaporator.

3. The dual-mode thermal management loop system of claim 2, wherein in the passive-capillary mode all the liquid entering the evaporator evaporates to gas.

4. The dual-mode thermal management loop system of claim 1, wherein the second valve controls flow of gas from the evaporator.

5. The dual-mode thermal management loop system of claim 2, wherein the porous media evaporator is a first porous media evaporator, wherein the dual-mode thermal management loop system further comprises a second porous media evaporator.

6. The dual-mode thermal management loop system of claim 5, wherein the first porous media evaporator and the second porous media evaporator are arranged in parallel.

7. The dual-mode thermal management loop system of claim 6, wherein the first porous media evaporator comprises two porous tubes arranged in parallel.

8. The dual-mode thermal management loop system of claim 2, wherein the porous media evaporator comprises an average pore size diameter of between about 1.0 micrometer and about 5.0 micrometers.

* * * * *